US007036755B2

(12) United States Patent
Takeda et al.

(10) Patent No.: US 7,036,755 B2
(45) Date of Patent: May 2, 2006

(54) FUEL INJECTION VALVE FOR ENGINE

(75) Inventors: Keiso Takeda, Mishima (JP); Tomojiro Sugimoto, Susono (JP)

(73) Assignee: Toyota Jidosha Kabushiki Kaisha, Toyota (JP)

( * ) Notice: Subject to any disclaimer, the term of this patent is extended or adjusted under 35 U.S.C. 154(b) by 173 days.

(21) Appl. No.: 10/793,890

(22) Filed: Mar. 8, 2004

(65) Prior Publication Data

US 2004/0178286 A1 Sep. 16, 2004

(30) Foreign Application Priority Data

Mar. 11, 2003 (JP) ..... 2003-065125

(51) Int. Cl.
*F02M 39/00* (2006.01)
*F02M 59/00* (2006.01)
*F02M 61/00* (2006.01)
*B05B 1/30* (2006.01)

(52) U.S. Cl. ..... 239/533.3; 239/533.2; 239/88; 239/533.12; 239/585.1; 239/585.5

(58) Field of Classification Search ..... 239/533.3, 239/533.2, 88–95, 533.1, 533.12, 585.1, 239/585.3, 585.4, 585.5; 251/129.15, 129.21, 251/127
See application file for complete search history.

(56) References Cited

U.S. PATENT DOCUMENTS 5,460,329 A * 10/1995 Sturman ..... 239/96
5,485,957 A * 1/1996 Sturman ..... 239/88
5,890,459 A * 4/1999 Hedrick et al. ..... 123/27 GE
6,085,991 A * 7/2000 Sturman ..... 239/88

FOREIGN PATENT DOCUMENTS

JP A 9-32695 2/1997

* cited by examiner

*Primary Examiner*—Davis Hwu
(74) *Attorney, Agent, or Firm*—Oliff & Berridge, PLC

(57) ABSTRACT

A fuel injection valve, for an engine, comprising a nozzle body having a plurality of nozzle holes and a needle valve reciprocated in the nozzle body for controlling the inflow of the fuel into the nozzle holes is disclosed. The fuel is rendered to flow into the nozzle holes from a direction along the inner wall surface of the nozzle body around each of the nozzle holes in a first inflow mode, and from a direction substantially perpendicular to the inner wall surface of the nozzle body in a second inflow mode. The first inflow mode and the second inflow mode can be selectively switched to each other. The fuel is rendered to flow into the nozzle holes in the first inflow mode before the lapse of a predetermined time after the engine is started, and in the first or second mode as required after the lapse of the predetermined time.

12 Claims, 3 Drawing Sheets

FUEL INJECTION VALVE FOR ENGINE

BACKGROUND OF THE INVENTION

1. Field of the Invention

The present invention relates to a fuel injection valve for an engine.

2. Description of the Related Art

A technique for promoting the atomization of the fuel injected from the fuel injection valve is disclosed in Japanese Unexamined Patent Publication No. 9-32695. This patent publication contains a description to the effect that the fuel flows along the inner wall surface of the fuel injection valve into the nozzle holes of the fuel injection valve. When flowing into the nozzle holes, therefore, the fuel is separated from the inner wall surface of the fuel injection valve. The fuel that has flowed into the nozzle holes is whirled periodically, and the fuel injected from the nozzle holes develops a self-excited vibration, with the result that the atomization of the fuel injected from the fuel injection valve is promoted.

As long as the atomization of the fuel injected from the fuel injection valve is promoted, however, the distance that can be covered by the fuel injected from the fuel injection valve is generally reduced (i.e. what may be called the penetrating force of the injected fuel is reduced). Specifically, with the fuel injection valve described in Japanese Unexamined Patent Publication No. 9-32695, the atomization of the fuel is promoted to such an extent that the penetrating force of the injected fuel is reduced. In an internal combustion engine (hereinafter referred to as the "engine") so configured that the fuel is injected directly into the combustion chamber from the fuel injection valve, the air flows violently in the combustion chamber in the case where the load on the engine is large. In such a case, a small penetrating force of the injected fuel could fail to disperse the injected fuel sufficiently in the combustion chamber. This is an undesirable phenomenon hampering satisfactory fuel combustion. The engine having the fuel injection valve disclosed in this conventional technique, therefore, cannot sufficiently meet the requirement to burn the fuel satisfactorily when a large load is placed on the engine. This is not limited to the case when a large load is placed on the engine, but generally applies to a case in which a large penetrating force of the injected fuel is required to assure satisfactory combustion of the fuel.

Accordingly, the object of this invention is to provide a fuel injection valve for assuring satisfactory combustion of the fuel or, in particular, to a fuel injection valve which can burn the fuel satisfactorily as possible by promoting the atomization or increasing the penetrating force of the injected fuel, as required.

SUMMARY OF THE INVENTION

According to one aspect of this invention, there is provided a fuel injection valve, for an engine, comprising a nozzle body having a plurality of nozzle holes and a needle valve reciprocated in the nozzle body for controlling the inflow of the fuel through the nozzle holes, wherein the fuel is rendered to flow into each of the nozzle holes from the direction along the inner wall surface of the nozzle body around the nozzle hole in a first inflow mode, while the fuel is rendered to flow into each of the nozzle holes from the direction substantially perpendicular to the inner wall surface of the nozzle body around the nozzle hole rather than from the direction along the inner wall surface of the nozzle body around the nozzle hole in a second inflow mode, the inflow mode can be selectively switched between the first and second inflow modes, and wherein the fuel is rendered to flow into the nozzle holes in the first inflow mode before the lapse of a predetermined time after starting the engine, and the fuel is rendered to flow into the nozzle holes in selected one of the first inflow mode and the second inflow mode as required after the lapse of the predetermined time.

Also, in the case where the load required of the engine is smaller than a predetermined value after the lapse of the predetermined time length, the fuel may be rendered to flow into the nozzle holes in the first inflow mode, and in the case where the load required of the engine is larger than the predetermined value after the lapse of the predetermined time length, the fuel may be rendered to flow into the nozzle holes in the second inflow mode.

Also, in the case where the engine is in idle operation after the lapse of the predetermined time length, the fuel may be rendered to flow into the nozzle holes in the first inflow mode, and in the case where the engine is not in idle operation after the lapse of the predetermined time length, the fuel may be rendered to flow into the nozzle holes in the second inflow mode.

After the lapse of a predetermined time length, the inflow mode may be switched between the first and second inflow modes in accordance with the throttle opening degree, so that in the case where the throttle opening degree is smaller than a predetermined value after the lapse of the predetermined time length, the fuel may be rendered to flow into the nozzle holes in the first inflow mode, and in the case where the throttle opening degree is larger than the predetermined value after the lapse of the predetermined time length, the fuel may be rendered to flow into the nozzle holes in the second inflow mode.

The lift amount of the needle valve from the inner wall surface of the nozzle body may be switched in at least two steps, so that the fuel may be rendered to flow into the nozzle holes in the first inflow mode by setting the lift amount of the needle valve to a small lift amount, and the fuel may be rendered to flow into the nozzle holes in the second inflow mode by setting the lift amount of the needle valve to a large amount.

Each of the nozzle holes may extend from the inner wall surface of the nozzle body to the outer wall surface of the nozzle body so that the fuel flows into the nozzle holes by changing the inflow direction of the fuel into the nozzle holes to an acute angle from the direction along the inner wall surface of the nozzle body around each of the nozzle holes.

Also, each of the nozzle holes may have at least one adjoining nozzle hole thereby to constitute a set of nozzle holes, and the nozzle holes of each set extend from the inner wall surface of the nozzle body to the outer wall surface of the nozzle body so that the fuel injected from the nozzle holes of each set bombard each other.

According to another aspect of the invention, there is provided a fuel injection valve for an engine, comprising a nozzle body having a plurality of nozzle holes and a needle valve reciprocated in the nozzle body for controlling the inflow of the fuel into the nozzle holes, wherein the fuel is rendered to flow into the nozzle holes from the direction along the inner wall surface of the nozzle body around each of the nozzle holes in a first inflow mode, while the fuel is rendered to flow into the nozzle holes from the direction substantially perpendicular to the inner wall surface of the nozzle body around each of the nozzle holes rather than from the direction along the inner wall surface of the nozzle body around each of the nozzle holes in a second inflow mode, the inflow mode can be selectively switched between the first and second inflow modes, and wherein the fuel is rendered to flow into the nozzle holes in the first inflow mode in the case where the load required of the engine is smaller than a predetermined value while the fuel is rendered to flow into the nozzle holes in the second inflow mode as required in the case where the load required of the engine is larger than the predetermined value.

Also, the throttle valve opening degree may be employed as a parameter representing the load required of the engine, so that the fuel is rendered to flow into the nozzle holes in the first inflow mode in the case where the throttle valve opening degree is smaller than a predetermined value, while the fuel is rendered to flow into the nozzle holes in the second inflow mode in the case where the throttle opening degree is larger than the predetermined value.

The lift amount of the needle valve from the inner wall surface of the nozzle body may be switched in at least two steps, so that the fuel is rendered to flow into the nozzle holes in the first inflow mode by setting the lift amount of the needle valve to a small lift amount, and the fuel is rendered to flow into the nozzle holes in the second inflow mode by setting the lift amount of the needle valve to a large lift amount.

Each of the nozzle holes may extend from the inner wall surface of the nozzle body to the outer wall surface of the nozzle body so that the fuel flows into each of the nozzle holes by changing the inflow direction of the fuel into the nozzle hole to an acute angle from the direction along the inner wall surface of the nozzle body around the nozzle hole.

Also, each of the nozzle holes may have at least one adjoining nozzle hole thereby to constitute a set of nozzle holes, and the nozzle holes of each set extend from the inner wall surface of the nozzle body to the outer wall surface of the nozzle body so that the fuels injected from the nozzle holes of each set bombard each other.

BRIEF DESCRIPTION OF THE DRAWINGS

The present invention may be more fully understood from the description of the preferred embodiments of the invention set forth below together with the accompanying drawings, in which.

DESCRIPTION OF THE PREFERRED EMBODIMENTS

Figure 1:
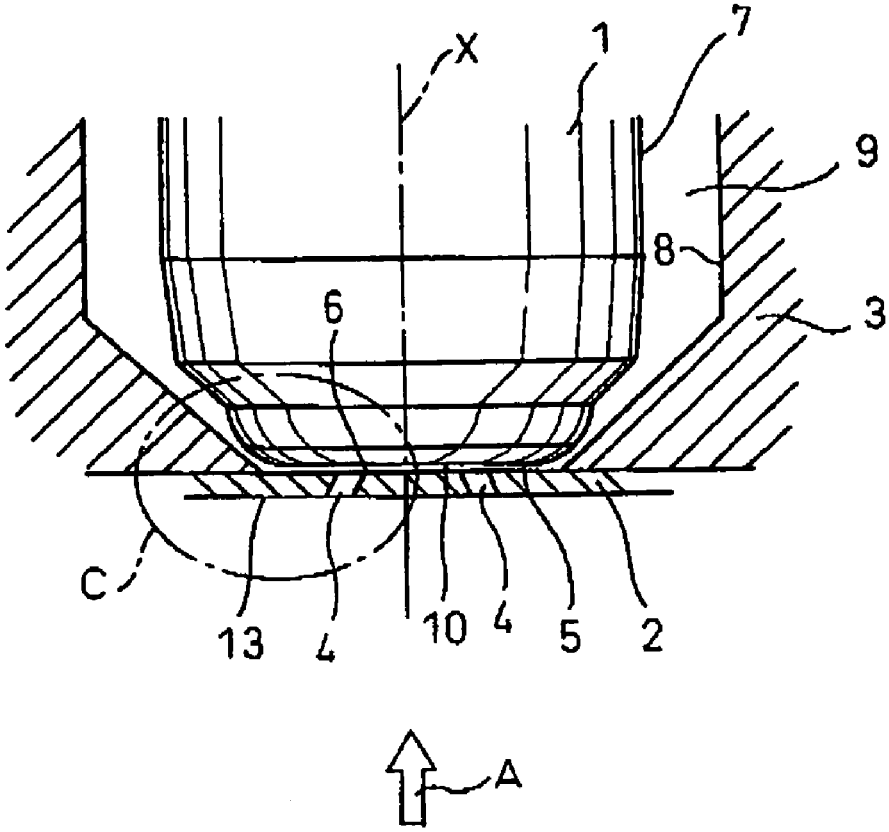
FIG. 1 is a partial sectional view of a fuel injection valve according to an embodiment of the invention.

An embodiment of the invention is explained below with reference to the drawings. FIG. 1 shows the structure of the forward end portion of a fuel injection valve. The fuel injection valve according to this embodiment is used mainly for the engine of such a type that the fuel is injected directly into the combustion chamber. Nevertheless, the fuel injection valve according to this embodiment is applicable also to an engine of such a type that the fuel is not directly injected into the combustion chamber (such a type that the fuel is injected into an intake port, for example) as far as the functions and effects of the fuel injection valve according to this embodiment described below are required.

Figure 2:
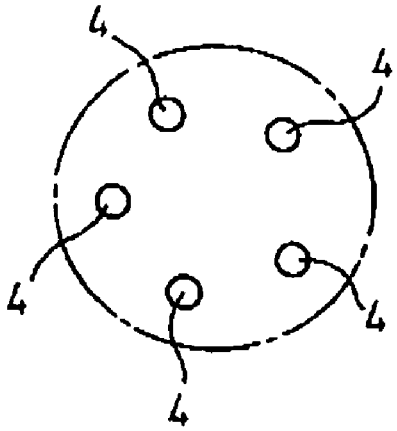
FIG. 2 is a diagram showing the nozzle holes of the fuel injection valve as viewed along the arrow A shown in FIG. 1.
Figure 3:
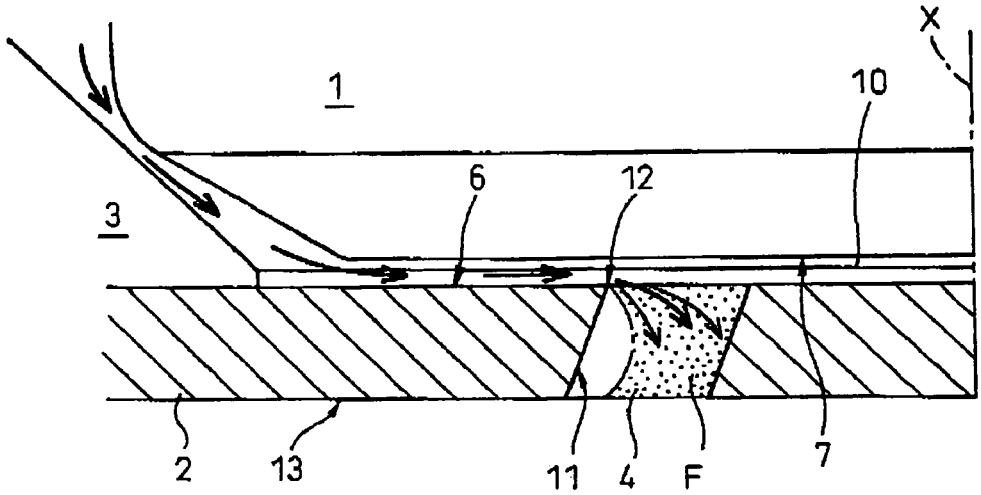
FIG. 3 is an enlarged view of the circular portion C in FIG. 1 with the needle valve set to a small lift amount.

Referring to FIGS. 1 to 3, reference numeral 1 designates a needle valve, numeral 2 a metering member, and numeral 3 a nozzle body. The metering member 2 is a substantially flat member and has a plurality of nozzle holes (five nozzle holes according to this embodiment, as shown in FIG. 2) 4 for injecting the fuel. The nozzle holes 4 are formed in the metering member 2 in spaced relation with each other at equal angles about the longitudinal axis X of the fuel injection valve, as shown in FIG. 2.

The needle valve 1 is reciprocated along the axis X of FIG. 1 in the fuel injection valve (specifically, in the nozzle body 3) by a well-known means. The forward end wall surface 5 of the needle valve 1 is flat, and so is the inner wall surface 6 of the metering member 2. The forward end wall surface 5 of the needle valve 1 is adapted to contact the inner wall surface 6 of the metering member 2. Once the forward end wall surface 5 of the needle valve 1 comes into contact with the inner wall surface 6 of the metering member 2, the nozzle holes 4 are closed by the forward end wall surface 5 of the needle valve 1, in which case no fuel is injected from the nozzle holes 4. In the case where the forward end wall surface 5 of the needle valve 1 leaves the inner wall surface 6 of the metering member 2, on the other hand, the high-pressure fuel that has thus far stayed in the space around the needle valve 1 (i.e. the space formed between the outer peripheral wall surface 7 of the needle valve 1 and the inner peripheral wall surface 8 of the nozzle body 3) flows into a space 10 formed between the forward end wall surface 5 of the needle valve 1 and the inner wall surface 6 of the metering member 2 from around the forward end wall surface 5 of the needle valve 1. This fuel further flows into the nozzle holes 4 and is finally ejected from the nozzle holes 4.

If the distance measured between the forward end wall surface 5 of the needle valve 1 and the inner wall surface 6 of the metering member 2 along the axis X when the forward end surface 5 of the needle valve 1 is separated from the inner wall surface 6 of the metering member 2 is referred to as "the lift amount of the needle valve", according to this embodiment, the lift amount of the needle valve 1 can be set in two stages. Specifically, the lift amount of the needle valve 1 can be switched selectively between a large lift amount and a small lift amount. Nevertheless, the lift amount of the needle valve 1 can alternatively be set in more than two stages. Generally speaking, this invention is applicable to a case in which the lift amount of the needle valve 1 can be set in at least two stages.

In the case where the needle valve 1 is lifted by the small lift amount, the high-pressure fuel that has thus far stayed around the needle valve 1 flows from around the forward end wall surface 5 of the needle valve 1 into a space (hereinafter referred to as the "variable fuel space" for its variable volume in accordance with the lift amount of the needle valve 1) 10 formed between the forward end wall surface 5 of the needle valve 1 and the inner wall surface 6 of the metering member 2. The width of the variable fuel space 10 measured along the axis X is so small that the fuel that has flowed into the variable fuel space 10 continues to flow in the form of thin film along the flat inner wall surface 6 of the metering member 2. Once the fuel flowing along the flat inner wall surface 6 of the metering member 2 reaches a nozzle hole 4, as shown in FIG. 3 (in which the arrows indicate the fuel flow), the fuel enters the nozzle hole 4 while at the same time being separated from the inner wall surface 6 of the metering member 2 at the edge (that circular edge portion defined by the inner wall surface 6 of the metering member 2 and the cylindrical wall surface 11 defining the nozzle hole 4 which is farther from the axis X and nearer to the periphery of the forward end wall surface 5 of the needle valve 1) 12 of the inlet of the nozzle hole 4. In other words, the fuel flows into the nozzle hole 4 from the direction along the inner wall surface 6 of the metering member 2. In the case where the fuel flows into the nozzle hole 4 while being separated from the inner wall surface 6 of the metering member 2 in this way, the atomization of the fuel injected from the nozzle holes 4 is promoted. In FIG. 3, the fuel that has flowed into the nozzle hole 4 occupies an area F, indicated by half-tone dots, in the nozzle hole 4.

Also, according to this embodiment, each nozzle hole 4 extends to the outer wall surface 13 of the metering member 2 from the inner wall surface 6 of the metering member 2 diagonally towards and diametrically away from the axis X. That is to say, the center axis of the nozzle hole 4 extends radially from a point on the axis X and the direction along the inner wall surface 6 of the metering member 2 and the direction along which the nozzle hole 4 extends (the direction in which the nozzle hole 4 extends toward the outer wall surface 13 of the metering member 2 from the inner wall surface 6 of the metering member 2) forms an acute angle. In other words, the nozzle hole 4 extends to the outer wall surface 13 of the metering member 2 from the inner wall surface 6 of the metering member 2 in such a manner that the fuel flows into the nozzle hole 4 by changing its inflow direction into the nozzle hole 4 to an acute angle from the direction along the inner wall surface 6 of the metering member 2 around the nozzle hole 4. In view of the extension of the nozzle hole 4 in this direction, when the fuel reaches and flows into the nozzle holes 4, the separation of the fuel from the edge 12 of the cylindrical wall surface 11 defining the nozzle hole 4 is promoted. As a result, the atomization of the injected fuel is further promoted.

If the metering member 2 and the nozzle body 3 are collectively referred to as a nozzle body, and the manner in which the fuel flows into each nozzle hole 4 with the needle valve 1 lifted by the small lift amount is referred to as a first inflow mode. In the first inflow mode, the fuel is generally considered to flow into the nozzle hole 4 from the direction along the inner wall surface of the nozzle body around the nozzle hole 4.

Figure 4:
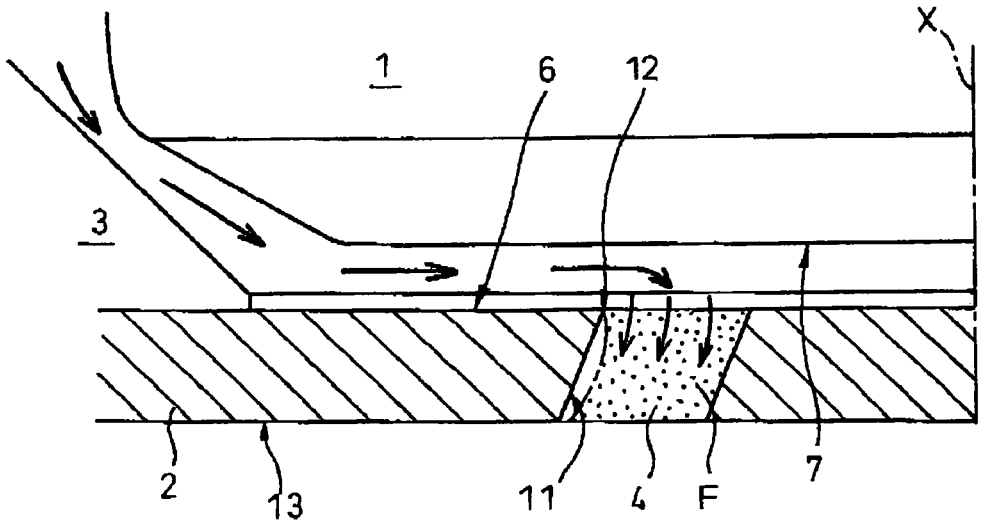
FIG. 4, like FIG. 3, is a diagram showing the needle valve set to a large lift amount.

In the case where the needle valve 1 is lifted by the large lift amount, on the other hand, the high-pressure fuel that has thus far stayed around the needle valve 1 flows into the variable fuel space 10 from around the forward end wall surface 5 of the needle valve 1 and macroscopically flows along the flat inner wall surface 6 of the metering member 2. In view of the fact that the width of the variable fuel space 10 measured along the axis X is larger than the width thereof with the needle valve 1 lifted by the small lift amount, however, as shown in FIG. 4 (in which the arrows indicate the direction of the fuel flow), the fuel flows into the nozzle hole 4 through the area of the variable fuel space 10 near the needle valve 1 rather than by being separated from the inner wall surface 6 of the metering member 2 at the edge 12 of the cylindrical wall surface 11 defining the nozzle hole 4. In other words, the fuel flows into the nozzle hole 4 from the direction substantially perpendicular to the inner wall surface 6 of the metering member 2 rather than from the direction along the inner. wall surface 6 of the metering member 2. Once the fuel flows into the nozzle hole 4 from the area of the variable fuel space 10 near the needle valve 1 in this way, the distance that can be reached by the fuel injected from each nozzle hole 4 (hereinafter referred to as the "penetrating force of the injected fuel") is lengthened. In FIG. 4, the fuel that has flowed into the nozzle hole 4 occupies an internal area F, of the nozzle hole 4, indicated by half-tone dots.

Assume that the metering member 2 and the nozzle body 3 are collectively referred to as a nozzle body, and the manner in which the fuel flows into the nozzle hole 4 with the needle valve 1 lifted by the large lift amount is referred to as a second inflow mode. In the second inflow mode, the fuel is generally considered to flow into the nozzle hole 4 from the direction substantially perpendicular to the inner wall surface of the nozzle body around the nozzle hole 4 rather than from the direction along the inner wall surface of the nozzle body around the nozzle hole 4.

As described above, this invention is applicable also to a case in which the lift amount of the needle valve 1 can be set in more than two stages. In the case where the promotion of atomization of the injected fuel is desired, the needle valve 1 is set to a smaller lift amount, while in the case where a larger penetrating force of the injected fuel is desired, the needle valve 1 is set to a larger lift amount.

Next, a method of switching the inflow mode according to this embodiment is explained. Before the lapse of a predetermined length of time after starting the engine, the temperature of the engine (especially, the temperature of the wall surface defining the combustion chamber) generally remains low and therefore, the fuel is not easily burnt in the combustion chamber. Once the atomization of the injected fuel is promoted, however, the fuel is more easily burnt. For the fuel to be burnt satisfactorily, therefore, atomization of the injected fuel is recommended. Upon the lapse of the predetermined length of time after starting the engine, on the other hand, the temperature of the engine increases and the fuel in the combustion chamber is more easily burnt. In the case where the load required of the engine (hereinafter simply referred to as the "required load") is large, however, the amount of the fuel injected from the fuel injection valve (hereinafter referred to as the "fuel injection amount") is increased and the air introduced into the combustion chamber flows violently. For the fuel to be easily burnt in the combustion chamber, therefore, the penetrating force of the injected fuel is required to be increased to disperse the fuel over a wide range in the combustion chamber. In the case where the required load is small upon the lapse of the predetermined length of time after starting the engine, on the other hand, the fuel injection amount is small and the air flow into the combustion chamber is not violent. To facilitate the burning of the fuel in the combustion chamber, therefore, it is desirable to promote the atomization of the injected fuel.

For this reason, according to this embodiment, before the lapse of a predetermined length of time (hereinafter referred to as the "engine starting period") after starting the engine (which is set to a time length sufficiently long for the engine temperature (which can be estimated from the temperature of the cooling water for cooling the engine or the temperature of the lubricant for lubricating the interior of the engine) to reach a level sufficiently high to burn the fuel satisfactorily), the fuel is caused to flow into each of the nozzle holes 4 in the first inflow mode and injected from the nozzle holes 4. By doing so, the atomization of the injected fuel is promoted, and therefore the fuel can be satisfactorily burnt in the combustion chamber.

In the case where the required load is larger than a predetermined load (which is set to such a threshold value at which the fuel comes to be burnt more satisfactorily by increasing the penetrating force of the injected fuel than by promoting the atomization of the injected fuel) after the lapse of the engine starting period, the fuel is supplied into the nozzle holes 4 in the second inflow mode and injected from the nozzle holes 4. In this way, the penetrating force of the injected fuel is increased, and therefore the fuel can be burnt satisfactorily in the combustion chamber.

Further, in the case where the required load remains smaller than the predetermined value after the lapse of the engine starting period, the fuel is supplied into the nozzle holes 4 in the first inflow mode and injected from the nozzle holes 4. In this way, the atomization of the injected fuel is promoted, and therefore the fuel can be similarly burnt satisfactorily.

Even during the engine starting period, the fuel may be allowed to flow into the nozzle holes 4 in the second inflow mode in the case where the engine temperature sufficiently increases. During the engine starting period, however, the satisfactory burning of the fuel is affected also by other factors than the engine temperature and not easily assured. Before the lapse of the engine starting period, therefore, the fuel is desirably introduced into the nozzle holes 4 in the first inflow mode regardless of the engine temperature.

Even in the case where the required load is larger than the predetermined load after the lapse of the engine starting period, the fuel may be allowed to flow into the nozzle holes 4 in the first inflow mode if the engine temperature is low. In the case where the required load is large, however, the penetrating force of the injected fuel is always required to be large. In the case where the required load is larger than the predetermined load after the lapse of the engine starting period, therefore, the fuel is more desirably supplied into the nozzle holes 4 in the second inflow mode regardless of the engine temperature.

Before the lapse of the engine starting period, on the other hand, the fuel is required to flow into the nozzle holes 4 at least in the first inflow mode. After the lapse of the engine starting period, however, the penetrating force of the injected fuel may be required to be increased for various reasons even in the case where the required load is smaller than the predetermined load. In such a case, even in the case where the required load is smaller than the predetermined load, the fuel may be supplied to the nozzle holes 4 in the second inflow mode. According to the above-mentioned embodiment of the invention, therefore, the fuel is generally considered to flow into the nozzle holes in the first inflow mode before the lapse of the engine starting period, and in the first or second inflow mode, as required, after the lapse of the engine starting period.

The required load is substantially proportional to the accelerator pedal (not shown) angle. According to the aforementioned embodiment, therefore, the required load can be estimated from the accelerator pedal angle. Also, assume that the engine is so configured that the opening degree ("throttle valve opening degree") of the throttle valve (the valve for controlling the amount of the air introduced into the combustion chamber) arranged in the intake pipe (the pipe used to introduce the air into the combustion chamber) is controlled in accordance with the accelerator pedal angle. The required load is substantially proportional to the throttle valve opening degree. In this embodiment, therefore, the required load can be estimated from the throttle valve opening degree. In this case, the flow mode may, of course, be set directly according to the throttle valve opening degree. Specifically, in the case where the throttle valve opening degree is larger than a predetermined opening degree (corresponding to the predetermined load) after the lapse of the engine starting period, the fuel is rendered to flow into the nozzle holes 4 in the second inflow mode, while in the case where the throttle opening degree is smaller than the predetermined opening degree after the lapse of the engine starting period, on the other hand, the fuel is introduced into the nozzle holes 4 in the first inflow mode.

According to this embodiment, the inflow mode may of course be determined taking the engine speed into account. Specifically, in the case where the engine speed is high, the air introduced into the combustion chamber flows violently, and the penetrating force of the injected fuel is required to be increased in order to burn the fuel satisfactorily. In the case where the engine speed is low, however, the air flow introduced into the combustion chamber is not so violent, and the promotion of the atomization of the injected fuel is required in order to burn the fuel satisfactorily. In this embodiment, therefore, as long as the required load is small and the engine speed is low after the lapse of the engine starting period, the fuel is rendered to flow into the nozzle holes 4 in the first inflow mode, while in the case where the required load is large and the engine speed is high after the lapse of the engine starting period, on the other hand, the fuel may be introduced into the nozzle holes 4 in the second inflow mode.

When the engine is idling (a state in which the accelerator pedal angle for determining the required load is zero) (hereinafter sometimes referred to as "the idle operation time"), the fuel injection amount is very small and the flow of the air into the combustion chamber is not violent. In order to facilitate the burning of the fuel in the combustion chamber, therefore, the atomization of the injected fuel is desirably promoted. According to this embodiment, therefore, during the idle operation time after the lapse of the engine starting time, the fuel may be supplied into the nozzle holes 4 in the first inflow mode, while during other than the idle operation time, the fuel may be introduced into the nozzle holes 4 in the second inflow mode.

Even at the idle operation time, the fuel may be supplied into the nozzle holes 4 in the second inflow mode if the engine temperature is high. In spite of the high engine temperature, however, it is still not easy to burn the fuel satisfactorily during the idle operation. During the idle operation, therefore, the fuel is more desirably introduced into the nozzle holes 4 in the first inflow mode regardless of the engine temperature.

An idle operation time can be determined based on the accelerator pedal angle. In the case where the accelerator pedal angle is zero, it is determined that the idle operation time is prevailing. With the engine so configured that the throttle opening degree is controlled in accordance with the accelerator pedal angle, an idle operation time may be determined when the throttle opening degree is smaller than a predetermined value (which is actually a value very near to zero). Also, in the aforementioned embodiment for controlling the inflow mode in accordance with the required load, assume that the predetermined load is set to the required load for the idle operation. Then, according to this embodiment, the fuel is rendered to flow into the nozzle holes 4 in the first inflow mode during the idle operation time after the lapse of the engine starting period, while the fuel is introduced into the nozzle holes 4 in the second inflow mode during times other than the idle operation time.

Figure 5A:
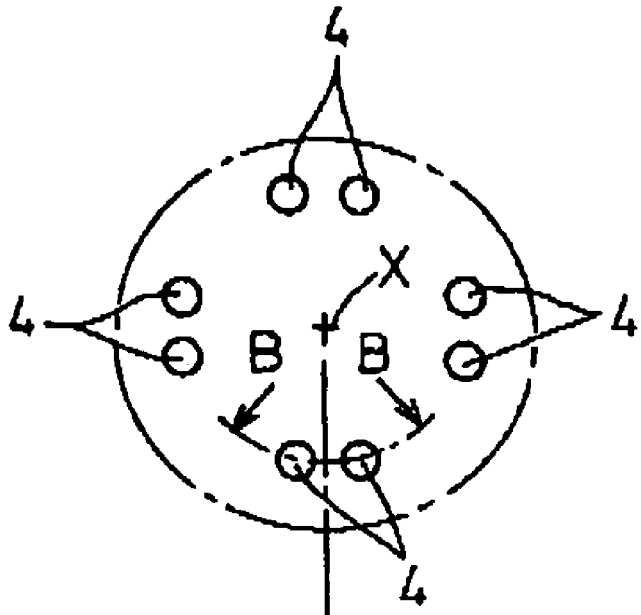
FIG. 5A, like FIG. 2, is a diagram showing the nozzle holes of the fuel injection valve according to another embodiment of the invention.
Figure 5B:
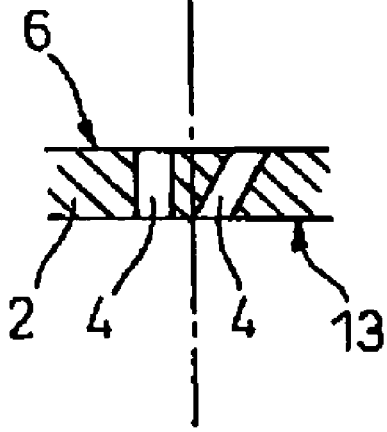
FIG. 5B is a sectional view taken in line B—B in FIG. 5A.

In the above-mentioned embodiment, as shown in FIGS. 5A and 5B, the fuel injection valve may comprise a plurality of (five in the shown case) sets of two adjoining nozzle holes 4, wherein the nozzle holes 4 of each set extend from the inner wall surface 6 of the metering member 2 to the outer wall surface 13 of the metering member 2 so that the fuel ejected from the nozzle holes 4 of each set bombard each other.

Even in the case where this fuel injection valve is employed, when the fuel is rendered to flow into the nozzle holes 4 in the first inflow mode (in which the needle valve 1 is lifted by a small lift amount), the fuel flows in the form of thin film along the inner wall surface 6 of the metering member 2. At the edge of the inlet of each nozzle hole 4 (that the edge defined by the inner wall surface 6 of the metering member 2 and the cylindrical wall surface defining the nozzle hole 4 which is farther from the axis X and nearer to the periphery of the forward end wall surface 5 of the needle valve 1), the fuel is separated from the inner wall surface 6 of the metering member 2 while flowing into each nozzle hole 4 of each set. Thus, the atomization of the injected fuel is promoted. According to this embodiment, the fuels injected from the nozzle holes of each set bombard each other, and therefore the atomization of the injected fuel is further promoted.

With this fuel injection valve, in a case in which the fuel is rendered to flow into the nozzle holes 4 in the second inflow mode (in which the needle valve 1 is lifted by the large lift amount), the fuel mainly flows into each nozzle hole 4 substantially along the center axis thereof from the area of the variable fuel space 10 nearer to the needle valve 1. Therefore, the penetrating force of the injected fuel is increased. Also, according to this embodiment, the fuel having a large penetrating force injected from the nozzle holes of each set bombard each other. Thus, the atomization of the injected fuel is also promoted.

The nozzle holes 4 of each set extend at least in such a direction that the fuels injected from the nozzle holes 4 can bombard each other. For the atomization of the injected fuel to be promoted further when the fuel is rendered to flow into the nozzle holes 4 in the first inflow mode, however, the direction of the fuel flowing into the nozzle holes 4 is preferably considerably different from the direction in which the fuel flows along the inner wall surface 6 of the metering member 2. For example, the fuel flow changes preferably to the direction substantially diagonal to the axis X diametrically away from the axis X.

In the embodiment described above, the same functions and effects of the invention are secured even in the case where the inner wall surface of the metering member is curved instead of flat.

According to this invention, in the first inflow mode, the fuel that has flowed along the inner wall surface of the nozzle body is rendered to flow into the nozzle holes. In this case, the fuel, when flowing into the nozzle holes, is separated from the inner wall surface of the nozzle body at the edge of the inlet of each nozzle hole. Therefore, the atomization of the fuel injected from the nozzle holes is promoted. In the second flow mode, on the other hand, the fuel flows into each nozzle hole from a direction substantially perpendicular to the inner wall surface of the nozzle body rather than the direction along the inner wall surface of the nozzle body. In this case, the fuel flows into each nozzle hole along the direction in which the nozzle hole extends, and therefore the penetrating force of the fuel injected from the nozzle holes is increased. Also, according to this invention, before the lapse of a predetermined time after starting the internal combustion engine (i.e. during the period when the fuel is not easy to burn), the fuel is rendered to flow into the nozzle holes in the first inflow mode. Thus, the atomization of the fuel is promoted and the fuel is burnt satisfactorily. Upon the lapse of the predetermined time after starting the engine (i.e. at the time when the fuel, though easier to burn, is desirably increased in penetrating force in order to burn in a more satisfactory fashion), on the other hand, the fuel is rendered to flow into the nozzle holes in the second inflow mode. In this way, the penetrating force of the fuel is increased and therefore the fuel is burnt in a satisfactory manner.

While the invention has been described by reference to specific embodiments chosen for purposes of illustration, it should be apparent that numerous modifications could be made thereto by those skilled in the art without departing from the basic concept and scope of the invention.

The invention claimed is:

1. A fuel injection valve for an engine, comprising a nozzle body having a plurality of nozzle holes and a needle valve reciprocated in said nozzle body for controlling the inflow of the fuel into the nozzle holes, wherein the fuel is rendered to flow into each of said nozzle holes from a direction along the inner wall surface of the nozzle body around said nozzle hole in a first inflow mode, while the fuel is rendered to flow into each of said nozzle holes from a direction substantially perpendicular to the inner wall surface of the nozzle body around said nozzle hole rather than from a direction along the inner wall surface of the nozzle body around said nozzle hole in a second inflow mode, the inflow mode can be selectively switched between said first and second inflow modes, and wherein the fuel is rendered to flow into the nozzle holes in the first inflow mode before the lapse of a predetermined time after starting the internal combustion engine, and the fuel is rendered to flow into said nozzle holes in selected one of said first inflow mode and said second inflow mode as required after the lapse of said predetermined time.

2. A fuel injection valve for an engine according to claim 1, wherein, in the case where the load required of the engine is smaller than a predetermined value after the lapse of said predetermined time, the fuel is rendered to flow into said nozzle holes in the first inflow mode, and in the case where the load required of the engine is larger than said predetermined value after the lapse of said predetermined time, the fuel is rendered to flow into said nozzle holes in the second inflow mode.

3. A fuel injection valve for an engine according to claim 1, wherein, in the case where the engine is in idle operation after the lapse of said predetermined time, the fuel is rendered to flow into said nozzle holes in the first inflow mode, and in the case where the engine is not in idle operation after the lapse of said predetermined time, the fuel is rendered to flow into said nozzle holes in the second inflow mode.

4. A fuel injection valve for an engine according to claim 1, wherein the inflow mode is switched between said first and second inflow modes in accordance with the throttle opening degree after the lapse of said predetermined time, so that in the case where the throttle valve opening degree is smaller than a predetermined value after the lapse of said predetermined time, the fuel is rendered to flow into said nozzle holes in the first inflow mode, and in the case where the throttle valve opening degree is larger than said predetermined value after the lapse of said predetermined time, the fuel is rendered to flow into said nozzle holes in the second inflow mode.

5. A fuel injection valve for an engine according to claim 1, wherein the lift amount of the needle valve from the inner wall surface of said nozzle body can be switched in at least two steps, so that the fuel is rendered to flow into said nozzle holes in the first inflow mode by setting the lift amount of said needle valve to a small lift amount, and the fuel is rendered to flow into said nozzle holes in the second inflow mode by setting the lift amount of said needle valve to a large lift amount.

6. A fuel injection valve for an engine according to claim 1, wherein each of said nozzle holes extends from the inner wall surface of said nozzle body to the outer wall surface of said nozzle body so that the fuel flows into each of said nozzle holes by changing the inflow direction of the fuel into said nozzle hole to an acute angle from the direction along the inner wall surface of the nozzle body around said nozzle hole.

7. A fuel injection valve for an engine according to claim 1, wherein each of said nozzle holes has at least one adjoining nozzle hole thereby to constitute a set of nozzle holes, and the nozzles of each set extend from the inner wall surface of the nozzle body to the outer wall surface of the nozzle body so that the fuels injected from said nozzle holes of each set bombard each other.

8. A fuel injection valve for an engine, comprising a nozzle body having a plurality of nozzle holes and a needle valve reciprocated in said nozzle body for controlling the inflow of the fuel into the nozzle holes, wherein the fuel is rendered to flow into said nozzle holes from a direction along the inner wall surface of the nozzle body around each of said nozzle holes in a first inflow mode, while the fuel is rendered to flow into said nozzle holes from a direction substantially perpendicular to the inner wall surface of the nozzle body around each of said nozzle holes rather than from a direction along the inner wall surface of the nozzle body around each of said nozzle holes in a second inflow mode, the inflow mode can be selectively switched between said first and second inflow modes, and wherein the fuel is rendered to flow into the nozzle holes in the first inflow mode in the case where the load required of the engine is smaller than a predetermined value, while the fuel is rendered to flow into said nozzle holes in the second inflow mode as required in the case where the load on the engine is larger than said predetermined value.

9. A fuel injection valve for an engine according to claim 8, wherein the throttle valve opening degree is employed as a parameter representing the load on the engine, so that the fuel is rendered to flow into the nozzle holes in the first inflow mode in the case where the throttle valve opening degree is smaller than a predetermined value, while the fuel is rendered to flow into said nozzle holes in the second inflow mode in the case where the throttle valve opening degree is larger than said predetermined value.

10. A fuel injection valve for an engine according to claim 8, wherein the lift amount of the needle valve from the inner wall surface of said nozzle body can be switched in at least two steps, so that the fuel is rendered to flow into said nozzle holes in the first inflow mode by setting the lift amount of said needle valve to a small lift amount, and the fuel is rendered to flow into said nozzle holes in the second inflow mode by setting the lift amount of said needle valve to a large lift amount.

11. A fuel injection valve for an engine according to claim 8, wherein each of said nozzle holes extends from the inner wall surface of said nozzle body to the outer wall surface of said nozzle body so that the fuel flows into each of said nozzle holes by changing the inflow direction of the fuel into said nozzle hole to an acute angle from the direction along the inner wall surface of said nozzle body around said nozzle hole.

12. A fuel injection valve for an engine according to claim 8, wherein each of said nozzle holes has at least one adjoining nozzle hole thereby to constitute a set of nozzle holes, and the nozzle holes of each set extend from the inner wall surface of the nozzle body to the outer wall surface of the nozzle body so that the fuel injected from said nozzle holes of each set bombard each other.

* * * * *